US008576259B2

(12) United States Patent
Lin et al.

(10) Patent No.: US 8,576,259 B2
(45) Date of Patent: Nov. 5, 2013

(54) PARTIAL UPDATE DRIVING METHODS FOR ELECTROPHORETIC DISPLAYS

(75) Inventors: Feng-Shou Lin, Chung-Li (TW); Wen-Pin Chiu, Taoyuan (TW); Craig Lin, San Jose, CA (US); Tin Pham, San Jose, CA (US)

(73) Assignee: Sipix Imaging, Inc., Fremont, CA (US)

( * ) Notice: Subject to any disclaimer, the term of this patent is extended or adjusted under 35 U.S.C. 154(b) by 754 days.

(21) Appl. No.: 12/764,839

(22) Filed: Apr. 21, 2010

(65) Prior Publication Data

US 2010/0271408 A1 Oct. 28, 2010

Related U.S. Application Data

(60) Provisional application No. 61/171,725, filed on Apr. 22, 2009.

(51) Int. Cl.
*G09G 5/10* (2006.01)

(52) U.S. Cl.
USPC ..... 345/690; 345/204; 345/55

(58) Field of Classification Search
USPC ..... 345/690, 204, 55
See application file for complete search history.

(56) References Cited

U.S. PATENT DOCUMENTS

| | | | | |
|---|---|---|---|---|
| 4,947,159 | A * | 8/1990 | Di Santo et al. | 345/107 |
| 6,930,818 | B1 | 8/2005 | Liang et al. | |
| 7,034,783 | B2 * | 4/2006 | Gates et al. | 345/84 |
| 8,081,155 | B2 * | 12/2011 | Kajino | 345/107 |
| 2003/0095094 | A1 * | 5/2003 | Goden | 345/107 |

FOREIGN PATENT DOCUMENTS

| | | |
|---|---|---|
| WO | WO 01/67170 | 9/2001 |

OTHER PUBLICATIONS

Allen, K. (Oct. 2003). Electrophoretics Fulfilled. *Emerging Displays Review: Emerging Display Technologies, Monthly Report*—Oct. 2003, 9-14.

Bardsley, J.N. & Pinnel, M.R. (Nov. 2004) Microcup™ Electrophoretic Displays. *USDC Flexible Display Report*, 3.1.2. pp. 3-12-3-16.

Chaug, Y.S., Haubrich, J.E., Sereda, M. and Liang, R.C. (Apr. 2004). Roll-to-Roll Processes for the Manufacturing of Patterned Conductive Electrodes on Flexible Substrates. *Mat. Res. Soc. Symp. Proc.*, vol. 814, I9.6.1.

Chen, S.M. (Jul. 2003) The Applications for the Revolutionary Electronic Paper Technology. *OPTO News & Letters*, 102, 37-41. (in Chinese, English abstract attached).

Chen, S.M. (May 2003) The New Application and the Dynamics of Companies. *TRI*. 1-10. (In Chinese, English abstract attached).

Chung, J., Hou, J., Wang, W., Chu, L.Y., Yao, W., & Liang, R.C. (Dec. 2003). Microcup® Electrophoretic Displays, Grayscale and Color Rendition. *IDW*, AMD2/EP1-2, 243-246.

(Continued)

*Primary Examiner* — William Boddie
*Assistant Examiner* — Leonid Shapiro
(74) *Attorney, Agent, or Firm* — Perkins Coie, LLP

(57) ABSTRACT

This application is directed to driving methods for electrophoretic displays. More specifically, the methods are suitable where there is a requirement for a partial update of the images in the display, where a partial update means that less than 10% of the pixels require updating. An essential element of the method is a floating common electrode. This method for partial updating may be used with the prior art driving techniques in order to provide the optimum updating method for different applications.

18 Claims, 11 Drawing Sheets

(56) References Cited

OTHER PUBLICATIONS

Ho, Andrew. (Nov. 2006) *Embedding e-Paper in Smart Cards, Pricing Labels & Indicators*. Presentation conducted at Smart Paper Conference Nov. 15-16, 2006, Atlanta, GA, USA.

Ho, C.,& Liang, R.C. (Dec. 2003). *Microcup® Electronic Paper by Roll-to-Roll Manufacturing Processes*. Presentation conducted at FEG, Nei-Li, Taiwan.

Ho, Candice. (Feb. 1, 2005) *Microcupt® Electronic Paper Device and Applicaiton*. Presentation conducted at USDC 4th Annual Flexible Display Conference 2005.

Hou, J., Chen, Y., Li, Y., Weng, X., Li, H. and Pereira, C. (May 2004). Reliability and Performance of Flexible Electrophoretic Displays by Roll-to-Roll Manufacturing Processes. *SID Digest*, 32.3, 1066-1069.

Kao, WC., (Feb. 2009) Configurable Timing Controller Design for Active Matrix Electrophoretic Dispaly. *IEEE Transactions on Consumer Electronics*, 2009, vol. 55, Issue 1, pp. 1-5.

Kao, WC., Fang, CY., Chen, YY., Shen, MH., and Wong, J. (Jan. 2008) Integrating Flexible Electrophoretic Display and One-Time Password Generator in Smart Cards. *ICCE 2008 Digest of Technical Papers*, p. 4-3. (Int'l Conference on Consumer Electronics, Jan. 9-13, 2008).

Kao, WC., Ye, JA., and Lin, C. (Jan. 2009) Image Quality Improvement for Electrophoretic Displays by Combining Contrast Enhancement and Halftoning Techniques. *ICCE 2009 Digest of Technical Papers*, 11.2-2.

Kao, WC., Ye, JA., Chu, MI., and Su, CY. (Feb. 2009) Image Quality Improvement for Electrophoretic Displays by Combining Contrast Enhancement and Halftoning Techniques. *IEEE Transactions on Consumer Electronics*, 2009, vol. 55, Issue 1, pp. 15-19.

Kao, WC., Ye, JA., Lin, FS., Lin, C., and Sprague, R. (Jan. 2009) Configurable Timing Controller Design for Active Matrix Electrophoretic Display with 16 Gray Levels. *ICCE 2009 Digest of Technical Papers*, 10.2-2.

Lee, H., & Liang, R.C. (Jun. 2003) SiPix Microcup® Electronic Paper—An Introduction. *Advanced Display*, Issue 37, 4-9 (in Chinese, English abstract attached).

Liang, R.C. (Feb. 2003) *Microcup® Electrophoretic and Liquid Crystal Displays by Roll-to-Roll Manufacturing Processes*. Presentation conducted at the Flexible Microelectronics & Displays Conference of U.S. Display Consortium, Phoenix, Arizona, USA.

Liang, R.C. (Apr. 2004). *Microcup Electronic Paper by Roll-to-Roll Manufacturing Process*. Presentation at the Flexible Displays & Electronics 2004 of Intertech, San Fransisco, California, USA.

Liang, R.C. (Oct. 2004) *Flexible and Roll-able Displays/Electronic Paper—A Technology Overview*. Paper presented at the METS 2004 Conference in Taipie, Taiwan.

Liang, R.C., & Tseng, S. (Feb. 2003). *Microcup® LCD, A New Type of Dispersed LCD by a Roll-to-Roll Manufacturing Process*. Paper presented at the IDMC, Taipei, Taiwan.

Liang, R.C., (Feb. 2005) *Flexible and Roll-able Displays/Electronic Paper—A Brief Technology Overview*. Flexible Display Forum, 2005, Taiwan.

Liang, R.C., Hou, J., & Zang, H.M. (Dec. 2002) Microcup Electrophoretic Displays by Roll-to-Roll Manufacturing Processes. *IDW*, EP2-2, 1337-1340.

Liang, R.C., Hou, J., Chung, J., Wang, X., Pereira, C., & Chen, Y. (May 2003). Microcup® Active and Passive Matrix Electrophoretic Displays by a Roll-to-Roll Manufacturing Processes. *SID Digest*, vol. 34, Issue 1, pp. 838-841, 20.1.

Liang, R.C., Hou, J., Zang, H.M., & Chung, J. (Feb. 2003). *Passive Matrix Microcup® Electrophoretic Displays*. Paper presented at the IDMC, Taipei, Taiwan.

Liang, R.C., Hou, J., Zang, H.M., Chung, J., & Tseng, S. (2003). Microcup® displays : Electronic Paper by Roll-to-Roll Manufacturing Processes. *Journal of the SID*, 11(4), 621-628.

Liang, R.C., Zang, H.M., Wang, X., Chung, J. & Lee, H., (Jun./Jul. 2004) << Format Flexible Microcup® Electronic Paper by Roll-to-Roll Manufacturing Process >>, Presentation conducted at the 14th FPD Manufacturing Technology EXPO & Conference.

Nikkei Microdevices. (Dec. 2002) Newly-Developed Color Electronic Paper Promises—Unbeatable Production Efficiency. *Nikkei Microdevices*, p. 3. (in Japanese, with English translation).

Sprague, R.A. (Sep. 23, 2009) SiPix Microcup Electrophoretic Epaper for Ebooks. *NIP 25 Technical Programs and Proceedings*, 2009 pp. 460-462.

Wang, X., Kiluk, S., Chang, C., & Liang, R.C. (Feb. 2004). Mirocup® Electronic Paper and the Converting Processes. *ASID*, 10.1.2-26, 396-399, Nanjing, China.

Wang, X., Kiluk, S., Chang, C., & Liang, R.C., (Jun. 2004) Microcup® Electronic Paper and the Converting Processes. *Advanced Display*, Issue 43, 48-51 (in Chinese, with English abstract).

Wang, X., Li, P., Sodhi, D., Xu, T. and Bruner, S. et al., (Feb. 2006) *Inkjet Fabrication of Multi-Color Microcup® Electrophorectic Display*. the Flexible Microelectronics & Displays Conference of U.S. Display Consortium.

Wang, X., Zang, HM., and Li, P. (Jun. 2006) Roll-to-Roll Manufacturing Process for Full Color Electrophoretic film. *SID Digest*, 00pp. 1587-1589.

Zang, H.M, Hwang, J.J., Gu, H., Hou, J., Weng, X., Chen, Y., et al. (Jan. 2004). Threshold and Grayscale Stability of Microcup® Electronic Paper. *Proceeding of SPIE-IS&T Electronic Imaging, SPIE* vol. 5289, 102-108.

Zang, H.M. & Hou, Jack, (Feb. 2005) *Flexible Microcup® EPD by RTR Process*. Presentation conducted at 2nd Annual Paper-Like Displays Conference, Feb. 9-11, 2005, St. Pete Beach, Florida.

Zang, H.M. (Oct. 2003). *Microcup® Electronic Paper by Roll-to-Roll Manufacturing Processes*. Presentation conducted at the Advisory Board Meeting, Bowling Green State University, Ohio, USA.

Zang, H.M. (Feb. 2004). *Microcup Electronic Paper*. Presentation conducted at the Displays & Microelectronics Conference of U.S. Display Consortium, Phoenix, Arizona, USA.

Zang, H.M., & Liang, R.C. (2003) Microcup Electronic Paper by Roll-to-Roll Manufacturing Processes. *The Spectrum*, 16(2), 16-21.

Zang, HM., (Feb. 2007) *Developments in Microcup® Flexible Displays*. Presentation conducted at the 6th Annual Flexible Display and Microelectronics Conference, Phoenix, AZ Feb. 6-8.

Zang, HM., (Sep. 2006) *Monochrome and Area Color Microcup® EPDs by Roll-to-Roll Manufacturing Process*. Presentation conducted at the Forth Organic Electronics Conference and Exhibition (OEC-06), Sep. 25-27, 2006, Frankfurt, Germany.

Zang, HM., Wang, F., Kang, Y.M., Chen, Y., and Lin, W. (Jul. 2007) *Microcup® e-Paper for Embedded and Flexible Designs*. IDMC'07, Taipei International Convention Center, Taiwan.

Zang, HM., Wang, W., Sun, C., Gu, H., and Chen, Y. (May 2006) Monochrome and Area Color Microcup® EPDs by Roll-to-Roll Manufacturing Processes. *ICIS '06 International Congress of Imaging Science Final Program and Proceedings*, pp. 362-365.

* cited by examiner

PARTIAL UPDATE DRIVING METHODS FOR ELECTROPHORETIC DISPLAYS

This application claims priority to U.S. Provisional Application No. 61/171,725, filed Apr. 22, 2009; the content of which is incorporated herein by reference in its entirety.

TECHNICAL FIELD

The present invention relates to driving methods for a display device, in particular, an electrophoretic display.

BACKGROUND OF THE INVENTION

An electrophoretic display (EPD) is a non-emissive device based on the electrophoresis phenomenon of charged pigment particles suspended in a solvent. The display usually comprises two plates with electrodes placed opposing each other. One of the electrodes is usually transparent. A suspension composed of a colored solvent and charged pigment particles is enclosed between the two plates. When a voltage difference is imposed between the two electrodes, the pigment particles migrate to one side or the other, according to the polarity of the voltage difference. As a result, either the color of the pigment particles or the color of the solvent may be seen at the viewing side. In general, an EPD may be driven by a uni-polar or bi-polar approach.

Most of the driving methods currently available for either uni-polar or bi-polar approach attempt to ensure that the images displayed have little or no residual image of the previous image. However, the driving time is long. In order to shorten the driving time, one can apply driving voltages only to the updated areas and apply no driving voltages to the non-updated areas. However, in practice, the driving voltage (the difference between the voltage applied to the pixel electrode and the voltage applied to the common electrode) is difficult to be kept at zero, which will cause the images to degrade in the non-updated areas.

In addition, currently available waveforms have disadvantages for driving two consecutive images which are similar, for example, the transition from one image to another may have a "flashing" appearance and also slow, or when non-flashing waveforms are used, the areas not intended to be changed are difficult to remain un-changed.

Relative to driving hardware, the currently available methods require separate circuits for the common electrode and the pixel electrodes.

SUMMARY OF THE INVENTION

The present invention is directed to driving methods for a display device, in particular, an electrophoretic display.

The first aspect of the invention is directed to a method for driving from a first image to a second image in an electrophoretic display wherein the second image comprises non-updated areas and updated areas, which method comprises the steps of:

a) applying a first voltage ($V_1$) to pixel electrodes associated with non-updated areas; and b) applying a second voltage ($V_2$) to pixel electrodes associated with updated areas;

whereby a floating common electrode has a third voltage ($V_3$); and a driving voltage created between the first voltage ($V_1$) and the third voltage ($V_3$) causes no visible image change in the non-updated areas and a driving voltage created between the second voltage ($V_2$) and the third voltage ($V_3$) is sufficient to cause the updated areas updated.

In the first aspect of the invention: In one embodiment, the third voltage ($V_3$) is based on the first voltage ($V_1$), the second voltage ($V_2$) and the percentages of the non-updated and updated areas (% $A_{NU}$ and % $A_U$). In one embodiment, the third voltage is:

$$V_3=V_1\times\%\,A_{NU}+V_2\times\%\,A_U$$

In one embodiment, the first voltage ($V_1$) is plus V (+V) and the second voltage ($V_2$) is minus V (−V) or vice versa. In one embodiment, the non-updated areas take up more than 90% between the first and second images. In one embodiment, the driving method is carried out in conjunction with a driving method for substantial image update in which the non-updated areas take up 90% or less, via a switch circuit.

The second aspect of the invention is directed to a bipolar method for driving from a first image to a second image in an electrophoretic display wherein the second image comprises non-updated areas, updated areas which will switch from a first color to a second color and updated areas which will switch from the second color to the first color, which method comprises the steps of:

a) applying a first voltage ($V_1$) to pixel electrodes associated with non-updated areas;

b) applying a second voltage ($V_2$) to pixel electrodes associated with updated areas which will switch from the first color to the second color; and c) applying a third voltage ($V_3$) to pixel electrodes associated with updated areas which will switch from the second color to the first color;

whereby a floating common electrode has a fourth voltage ($V_4$); and a driving voltage created between the first voltage ($V_1$) and the fourth voltage ($V_4$) causes no visible image change in the non-updated areas, a driving voltage created between the second voltage ($V_2$) and the fourth voltage ($V_4$) is sufficient to switch the updated areas from the first color to the second color and a driving voltage created between the third voltage ($V_3$) and the fourth voltage ($V_4$) is sufficient to switch the updated areas from the second color to the first color.

In the second aspect of the invention: In one embodiment, the fourth voltage ($V_4$) is based on the first voltage ($V_1$), the second voltage ($V_2$), the third voltage ($V_3$) and the percentages of the non-updated areas (% $A_{NU}$), the updated areas which will switch from the first color to the second color (% $A_{U1\rightarrow 2}$) and the updated areas which will switch from the second color to the first color (% $A_{U2\rightarrow 1}$). In one embodiment, the fourth voltage is:

$$V_4=V_1\times\%\,A_{NU}+V_2\times\%\,A_{U1\rightarrow 2}+V_3\times\%\,A_{U2\rightarrow 1}$$

In one embodiment, the non-updated areas takes up more than 90% between the first and second images. In embodiment, the first voltage ($V_1$) is 0V, the second voltage ($V_2$) is plus V (+V) and the third voltage ($V_3$) is minus V (−V) or the first voltage ($V_1$) is 0V, the second voltage ($V_2$) is minus V (−V) and the third voltage ($V_3$) is plus V (+V). In one embodiment, the driving method is carried out in conjunction with a driving method for substantial image update in which the non-updated areas take up 90% or less, via a switch circuit. In one embodiment, the first color is black and the second color is white or vice versa.

The third aspect of the invention is directed to a uni-polar method for driving from a first image to a second image in an electrophoretic display wherein the second image comprises non-updated areas, updated areas which will switch from a first color to a second color and updated areas which will switch from the second color to the first color, which method comprises the steps of:

a) applying a first voltage ($V_1$) to pixel electrodes associated with the non-updated areas and pixel electrodes associated with the updated areas which are to switch from the first color to the second color; and b) applying a second voltage ($V_2$) to pixel electrodes associated with the updated areas which will switch from the second color to the first color;

whereby a floating common electrode has a third voltage ($V_3$); and a driving voltage created between the first voltage ($V_1$) and the third voltage ($V_3$) causes no visible image change in the non-updated areas and the updated areas to switch from the first color to the second color and a driving voltage created between the second voltage and the third voltage causes the updated areas to switch from the second color to the first color.

The unipolar driving method may further comprise the steps of:

a) applying a fourth voltage ($V_4$) to pixel electrodes associated with the non-updated areas and pixel electrodes associated with the updated areas which already switched from the second color to the first color; and b) applying a fifth voltage ($V_5$) to pixel electrodes associated with the updated areas which will switch from the first color to the second color;

whereby a floating common electrode has a sixth voltage ($V_6$); and a driving voltage created between the fourth voltage ($V_4$) and the sixth voltage ($V_6$) causes no visible image change in the non-updated areas and the updated areas which have switched from the second color to the first color and a driving voltage created between the fifth voltage ($V_5$) and the sixth voltage ($V_6$) is sufficient to switch the updated areas from the first color to the second color.

In the third aspect of the invention: In one embodiment, the third voltage ($V_3$) is based on the first voltage ($V_1$), the second voltage ($V_2$) and the percentages of the non-updated areas (% $A_{NU}$) and the updated areas (% $A_U$). In one embodiment, the third voltage is:

$$V_3=V_1\times\%\,A_{NU}+V_2\times\%\,A_U$$

In one embodiment, the sixth voltage ($V_6$) is based on the fourth voltage ($V_4$), the fifth voltage ($V_5$) and the percentages of the non-updated areas (% $A_{NU}$) and the updated areas (% $A_U$). In one embodiment, the sixth voltage is:

$$V_6=V_4\times\%\,A_{NU}+V_5\times\%\,A_U$$

In one embodiment, the non-updated areas take up more than 90% between the first and second images. In one embodiment, the first voltage ($V_1$) is plus V (+V) and the second voltage ($V_2$) is minus V (−V) or vice versa. In one embodiment, the fourth voltage ($V_4$) is plus V (+V) and the fifth voltage ($V_5$) is minus V (−V) or vice versa. In one embodiment, the uni-polar driving method is carried out in conjunction with a driving method for substantial image update in which the non-updated areas take up 90% or less, via a switch circuit. In one embodiment, the first color is black and the second color is white or vice versa.

The fourth aspect of the invention is directed to a system for driving an electrophoretic display, which system comprises:

a common electrode drive circuit coupled to a switch circuit;

the switch circuit coupled to a common electrode of an electrophoretic display;

a backplane drive circuit coupled to pixel electrodes of the electrophoretic display; and wherein the switch circuit is a closed circuit when a substantial image update is required and the switch circuit is an open circuit when a partial image update is required.

In the fourth aspect of the invention, the substantial image update comprises more than about 10% of updated areas whereas the partial image update comprises less than about 10% of updated areas.

The driving methods of the present invention are especially desirable for partial image updates, especially for updating images which are similar between two consecutive images. The methods not only provide faster visual image transition to the viewers, but also cause no degradation in image qualities. In addition, the reflectance of the unchanged (or non-updated) areas is not affected within the driving time of the methods. Furthermore, the methods are energy efficient since no common electrode driving is required during image updates. A system is also described that incorporates a switch circuit to facilitate substantial updates and partial updates in the same display device.

DETAILED DESCRIPTION OF THE INVENTION

Figure 1:
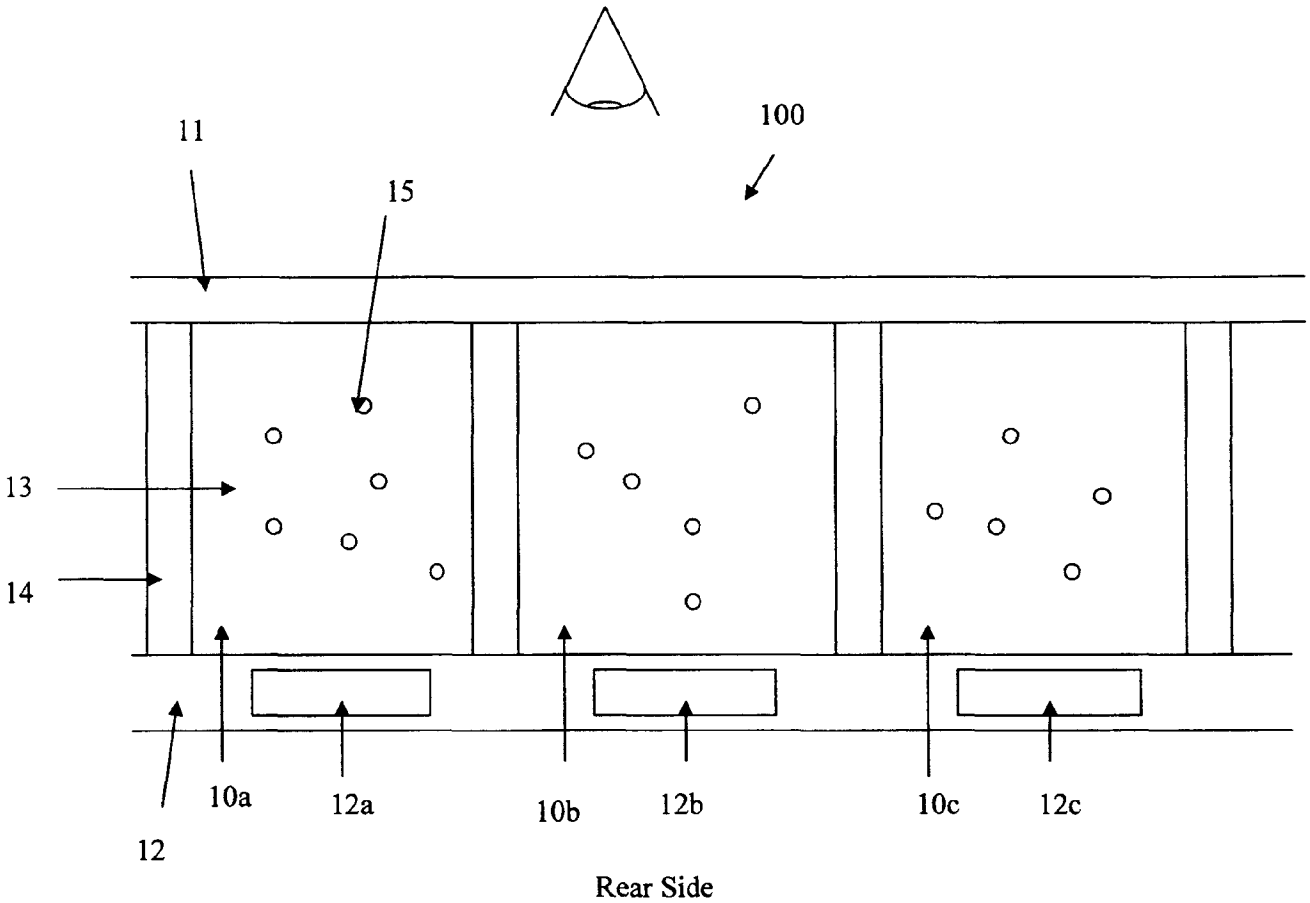
FIG. 1 is a cross-section view of a typical electrophoretic display device.

FIG. 1 illustrates a typical array of electrophoretic display cells 10*a*, 10*b* and 10*c* in a multi-pixel display 100 which may be driven by any of the driving methods presented herein. In FIG. 1, the electrophoretic display cells 10*a*, 10*b*, 10*c*, on the front viewing side indicated with the graphic eye, are provided with a common electrode 11 (which is usually transparent and therefore on the viewing side). On the opposing side (i.e., the rear side) of the electrophoretic display cells 10*a*, 10*b* and 10*c*, a substrate (12) includes discrete pixel electrodes 12*a*, 12*b* and 12*c*, respectively. Each of the pixel electrodes 12*a*, 12*b* and 12*c* defines an individual pixel of a multi-pixel electrophoretic display. However, in practice, a plurality of display cells (as a pixel) may be associated with one discrete pixel electrode. The pixel electrodes 12*a*, 12*b* and 12*c* may be segmented in nature rather than pixellated, defining regions of an image to be displayed rather than individual pixels. Therefore, while the term "pixel" or "pixels" is frequently used in this application to illustrate driving implementations, the driving implementations are also applicable to segmented displays.

It is also noted that the display device may be viewed from the rear side when the substrate 12 and the pixel electrodes are transparent.

An electrophoretic fluid 13 is filled in each of the electrophoretic display cells 10*a*, 10*b* and 10*c*. Each of the electrophoretic display cells 10*a*, 10*b* and 10*c* is surrounded by display cell walls 14.

The movement of the charged particles in a display cell is determined by the voltage potential difference applied to the common electrode and the pixel electrode associated with the display cell in which the charged particles are filled.

As an example, the charged particles 15 may be positively charged so that they will be drawn to a pixel electrode or the common electrode, whichever is at an opposite voltage potential from that of charged particles. If the same polarity is applied to the pixel electrode and the common electrode in a display cell, the positively charged pigment particles will then be drawn to the electrode which has a lower voltage potential.

The term "display cell" is intended to refer to a microcontainer which is individually filled with a display fluid. Examples of "display cell" include, but are not limited to, microcups, microcapsules, micro-channels, other partition-typed display cells and equivalents thereof.

In this application, the term "driving voltage" is used to refer to the voltage potential difference experienced by the charged particles in the area of a pixel. The driving voltage is the potential difference between the voltage of the common electrode and the voltage applied to the pixel electrode. For example, in a binary system where positively charged white particles are dispersed in a black solvent, when no voltage is applied to a common electrode and a voltage of +15V is applied to a pixel electrode, the "driving voltage" for the charged pigment particles in the area of the pixel would be +15V. In this case, the driving voltage would move the white particles to be near or at the common electrode and as a result, the white color is seen through the common electrode (i.e., the viewing side). Alternatively, when no voltage is applied to a common electrode and a voltage of −15V is applied to a pixel electrode, the driving voltage in this case would be −15V and under such −15V driving voltage, the positively charged white particles would move to be at or near the pixel electrode, causing the color of the solvent (black) to be seen at the viewing side.

In another embodiment, the charged pigment particles 15 may be negatively charged.

In a further embodiment, the electrophoretic display fluid could also have a transparent or lightly colored solvent or solvent mixture and charged particles of two different colors carrying opposite particle charges, and/or having differing electro-kinetic properties. For example, there may be white pigment particles which are positively charged and black pigment particles which are negatively charged and the two types of pigment particles are dispersed in a clear solvent or solvent mixture.

The charged particles 15 may be white. Also, as would be apparent to a person having ordinary skill in the art, the charged particles may be dark in color and are dispersed in an electrophoretic fluid 13 that is light in color to provide sufficient contrast to be visually discernable.

As stated, the electrophoretic display cells may be of a conventional walled or partition type, a microencapsulted type or a microcup type. In the microcup type, the electrophoretic display cells 10*a*, 10*b*, 10*c* may be sealed with a top sealing layer. There may also be an adhesive layer between the electrophoretic display cells 10*a*, 10*b*, 10*c* and the common electrode 11.

Figure 2:
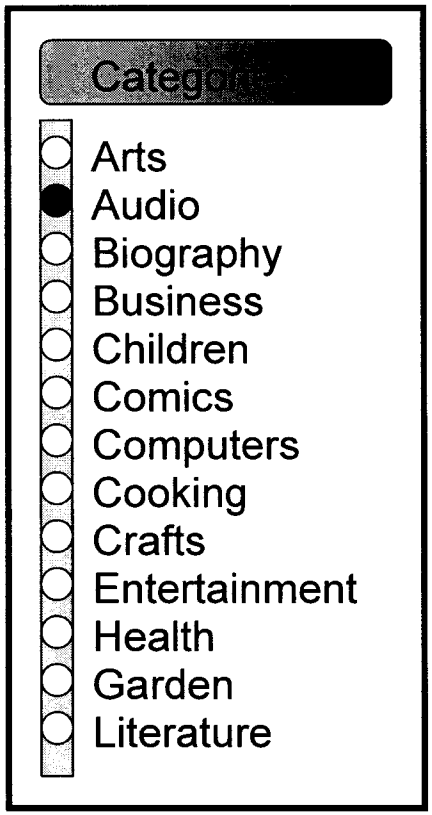
FIG. 2 illustrates partial image update between two consecutive images.
Figure 2:
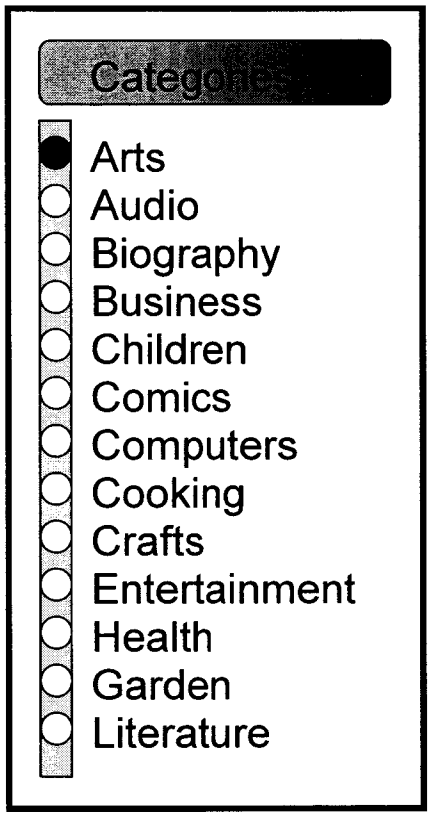

FIG. 2 is an example which shows that two consecutive images differ only slightly, that is, the selection expressed by a dot has moved from "arts" to "audio". The rest of the two images remain the same. In other words, the majority of the original image is not updated and only a very small portion of the original image is updated. The driving methods of the present invention are particularly suitable for this type of partial image update.

For brevity, throughout this application, the areas where no changes take place between two consecutive images are referred to as "non-updated" areas ($A_{NU}$) and the areas where the two consecutive images differ are referred to as "updated" areas ($A_U$). Likewise, the pixel electrodes associated with the non-updated areas are referred to as "non-updating" pixel electrodes and the pixel electrodes associated with the updated areas are referred to as "updating" pixel electrodes.

Figure 3:
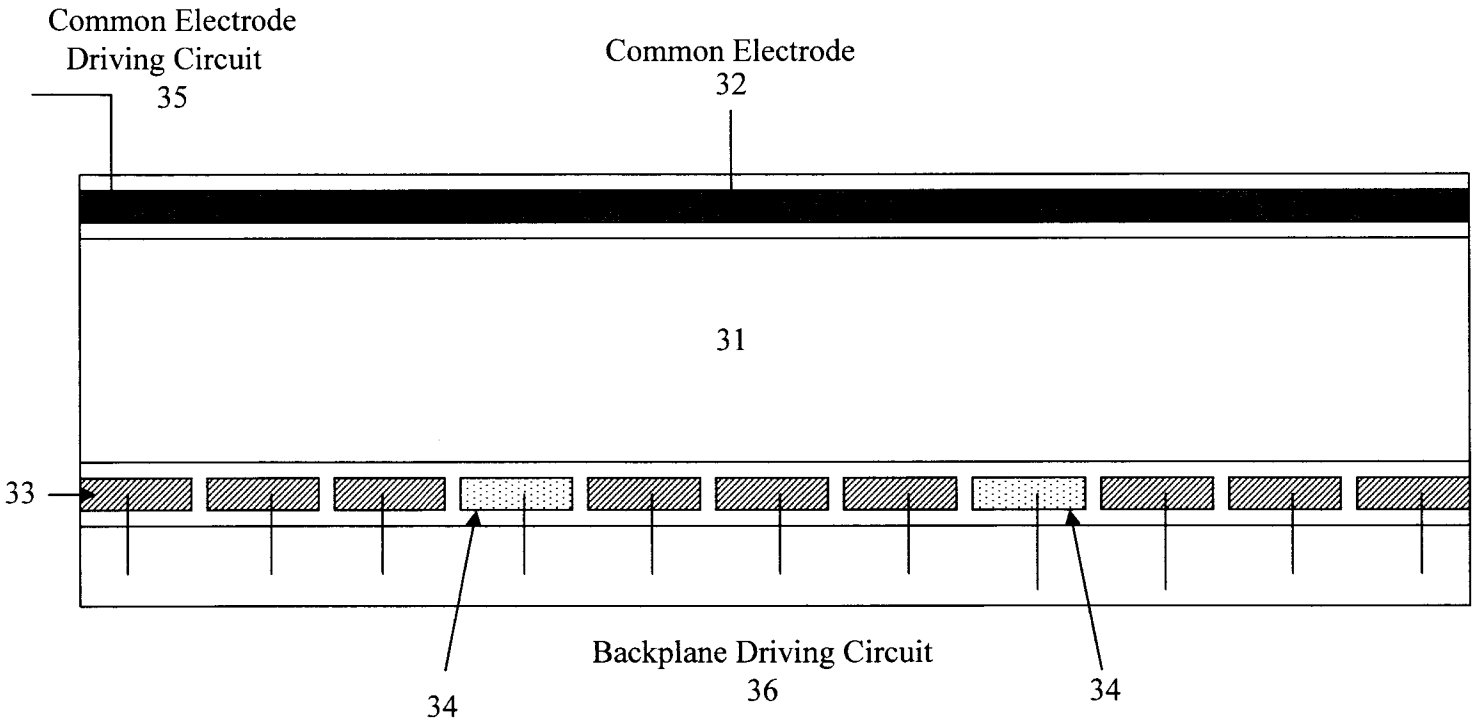
FIG. 3 illustrates a prior art driving methods.

FIG. 3 is a simplified diagram illustrating the methods currently used and their disadvantages. A display panel (31) is sandwiched between a common electrode (32) and a backplane comprising an array of pixel electrodes (33 and 34). The common electrode and the backplane are controlled by separate circuits, the common electrode driving circuit 35 and the backplane driving circuit 36. For simplicity, the display cell walls (element 14 in FIG. 1) are not shown in FIG. 3 and subsequent figures.

When driving from an image to another, the updated areas (associated with the "dotted" updating pixel electrodes 34) will experience a non-zero driving voltage, causing the charged pigment particles to move. However, the driving voltages for the non-updated areas (associated with the "lined" non-updating pixel electrodes 33) must be substantially zero.

For uni-polar applications, the pixels are driven to their destined color states in two driving phases. In phase one, selected pixels are driven from a first color to a second color. In phase two, the remaining pixels are driven from the second color to the first color.

For bi-polar applications, it is possible to update areas from a first color to a second color and also areas from the second color to the first color, at the same time. The bi-polar approach requires no modulation of the common electrode and the driving from one image to another image may be accomplished, as stated, in only one driving phase.

For the non-updated areas, in either the uni-polar approach or the bi-polar approach, the voltage of the common electrode must be substantially equal to the voltage applied to the pixel electrodes (i.e., zero driving voltage). However, in practice, it is very difficult to match precisely the voltage of the common electrode and the voltage applied to a pixel electrode. This could be due to the biased voltage experienced by the pixel electrodes. This deficiency may be possible to be remedied by fine tuning the voltage of the common electrode. However, such remedy could be cumbersome and costly. Furthermore, even if the difference in voltages between the common electrode and the pixel electrode is minor, the driving of one image to another may have to be repeated several times, eventually causing the images to be degraded in the non-updated areas.

The present invention is directed to driving methods for partial image updates. When the present driving methods are applied, preferably the updated areas between two consecutive images are about 15%, preferably about 10%, or less of the total image area. In other words, about 85%, preferably about 90%, or more of the original image is un-changed between the two consecutive images.

The essential feature of the driving methods is a "floating" common electrode. A "floating" common electrode is a common electrode which is not connected to a driving circuit.

Figure 4:
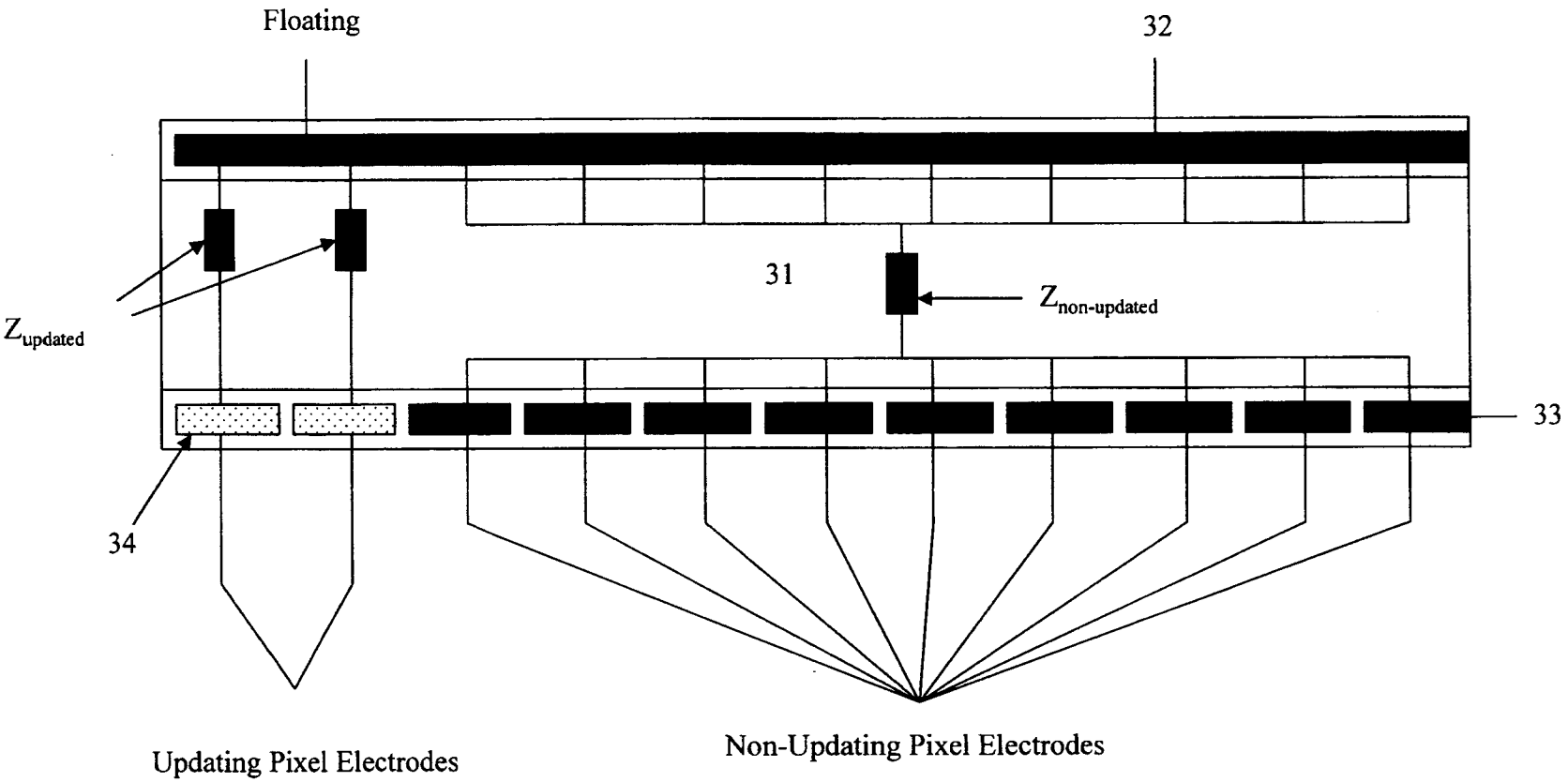
FIG. 4 shows an electrophoretic display in the form of an equivalent circuit.

The partial update driving methods of the present invention are possible because an electrophoretic display has a finite and fairly uniform resistance and capacitance on the vertical direction throughout the display. As expressed in FIG. 4, the ratio of the impedance $Z_{non\text{-}updated}$ to the impedance $Z_{Updated}$ is equal to the ratio of the updated area ($A_U$) to the non-updated area ($A_{NU}$).

In practice, when a voltage ($V_{NU}$) is applied to the non-updating pixel electrodes and another voltage ($V_U$) is applied to the updating pixel electrodes, the voltage of the floating common electrode will become:

$$V_{common}=\sigma\{V_U\times\%\,A_U\}+V_{NU}\times\%\,A_{NU}$$

To state differently, the floating common electrode will sense such a voltage. The "% $A_U$" is the percentage of the updated areas of the total image area and the "% $A_{NU}$" is the percentage of the non-updated areas of the total image area, between two consecutive images.

This "floating common electrode" provides significant benefits as will be described.

EXAMPLES

Example 1

Uni-polar Approach of the Driving Method

FIGS. 5*a*-5*d* illustrate a uni-polar driving method of the present invention. For ease of illustration in a one-dimensional diagram, it appears that the updating pixel electrodes are bundled together on one side and the non-updating pixel electrodes are bundled together on the other side, in FIGS. 4-6. However in practice, the updating pixel electrodes and the non-updating electrodes may appear anywhere and their locations are dictated only by the images displayed.

For FIGS. 5*a*-5*d* the common electrode 32 is no longer connected to a driving circuit. Instead, the common electrode is "floating".

Figure 5A:
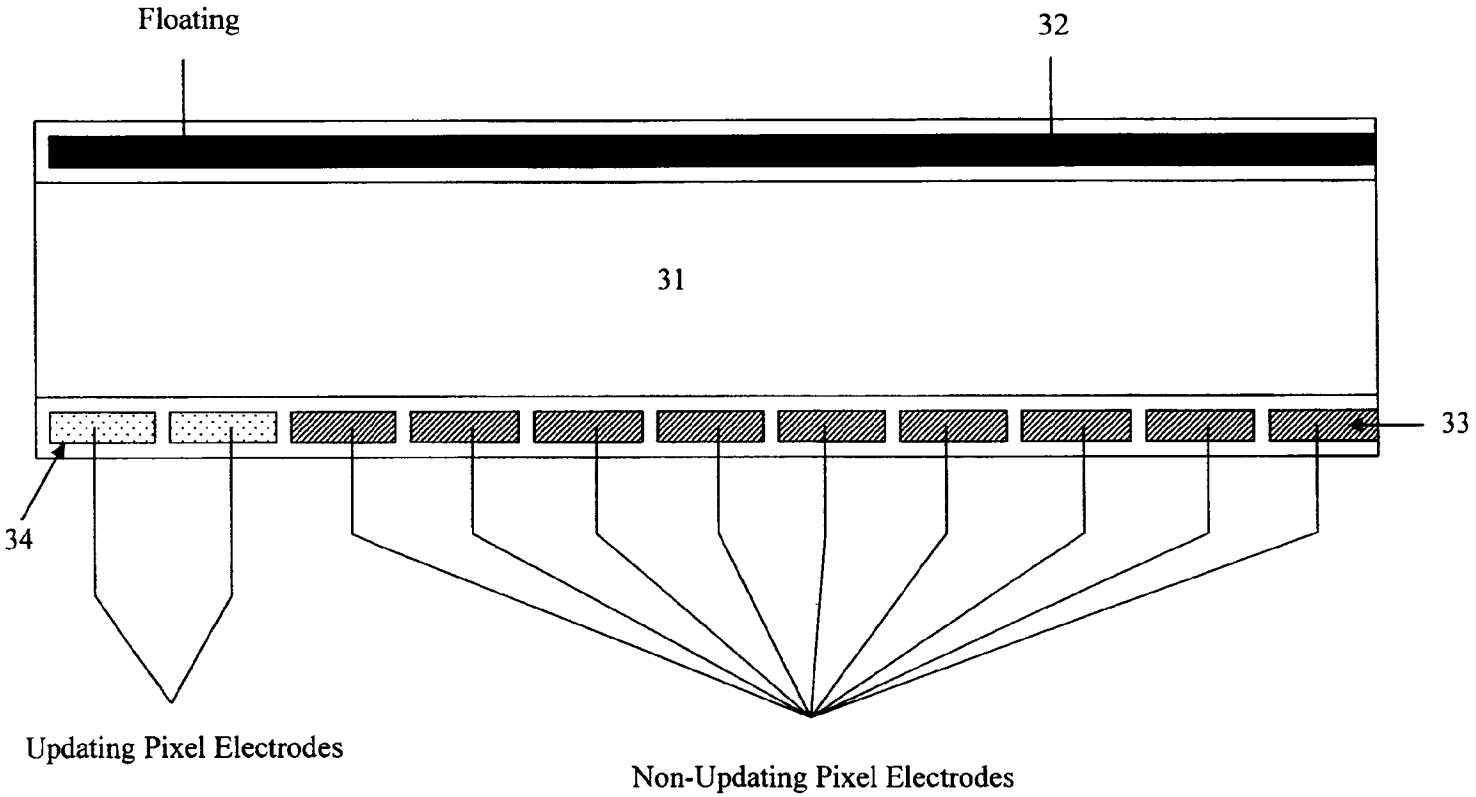
FIGS. 5*a*-5*d* illustrate a uni-polar driving method of the present invention.

FIG. 5*a* is a general diagram in which two updating pixel electrodes are on the left hand side which represent all updating pixel electrodes and the non-updating pixel electrodes are on the right hand side which represent all non-updating pixel electrodes. When driving from an image to another, a voltage is applied to all updating pixel electrodes and another voltage is applied to all non-updating pixel electrodes. It is also assumed, in this example, that the non-updated areas in two consecutive images are 99% (% $A_{NU}$) of the total image area. In other words, only 1% (% $A_U$) of the original image is updated.

Figure 5B:
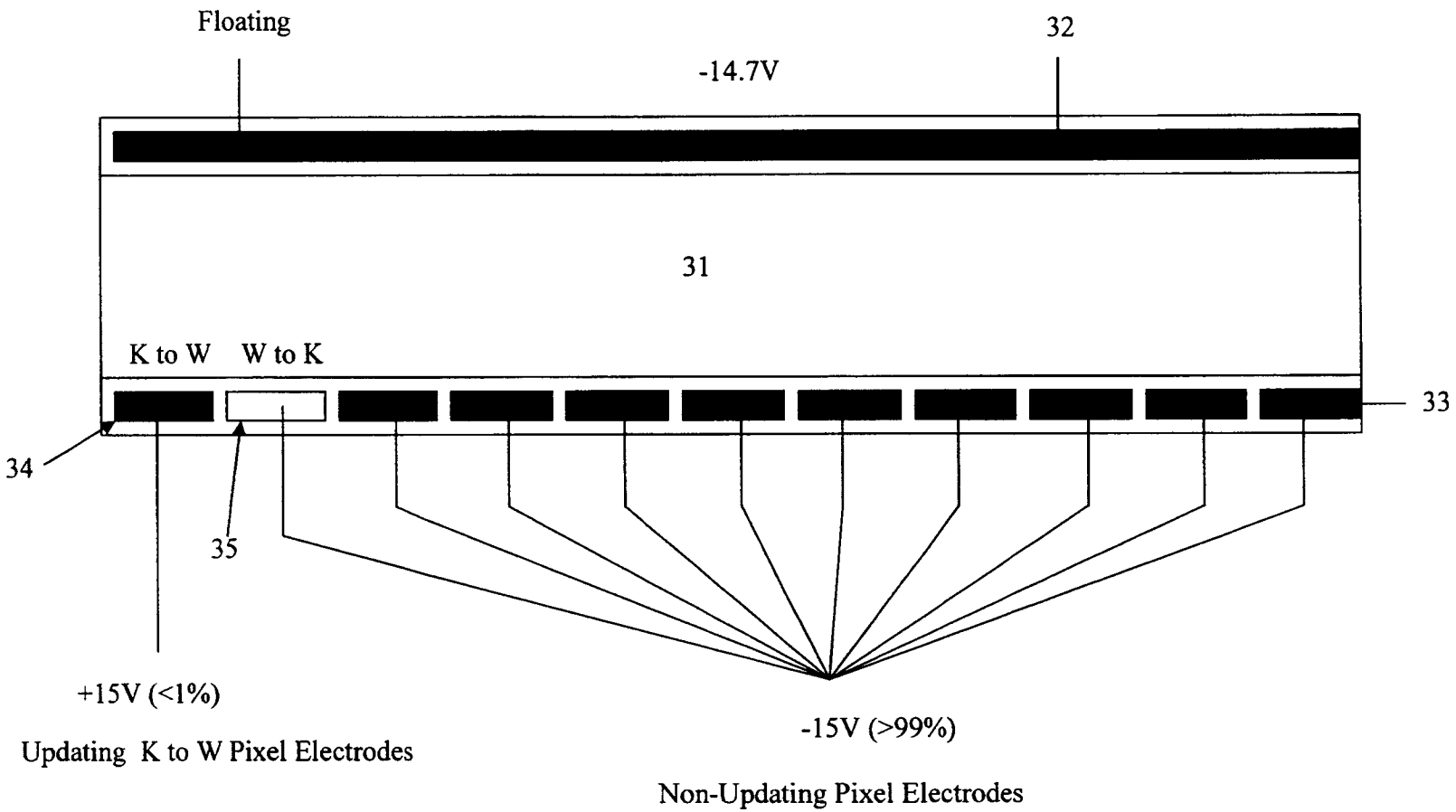
Figure 5C:
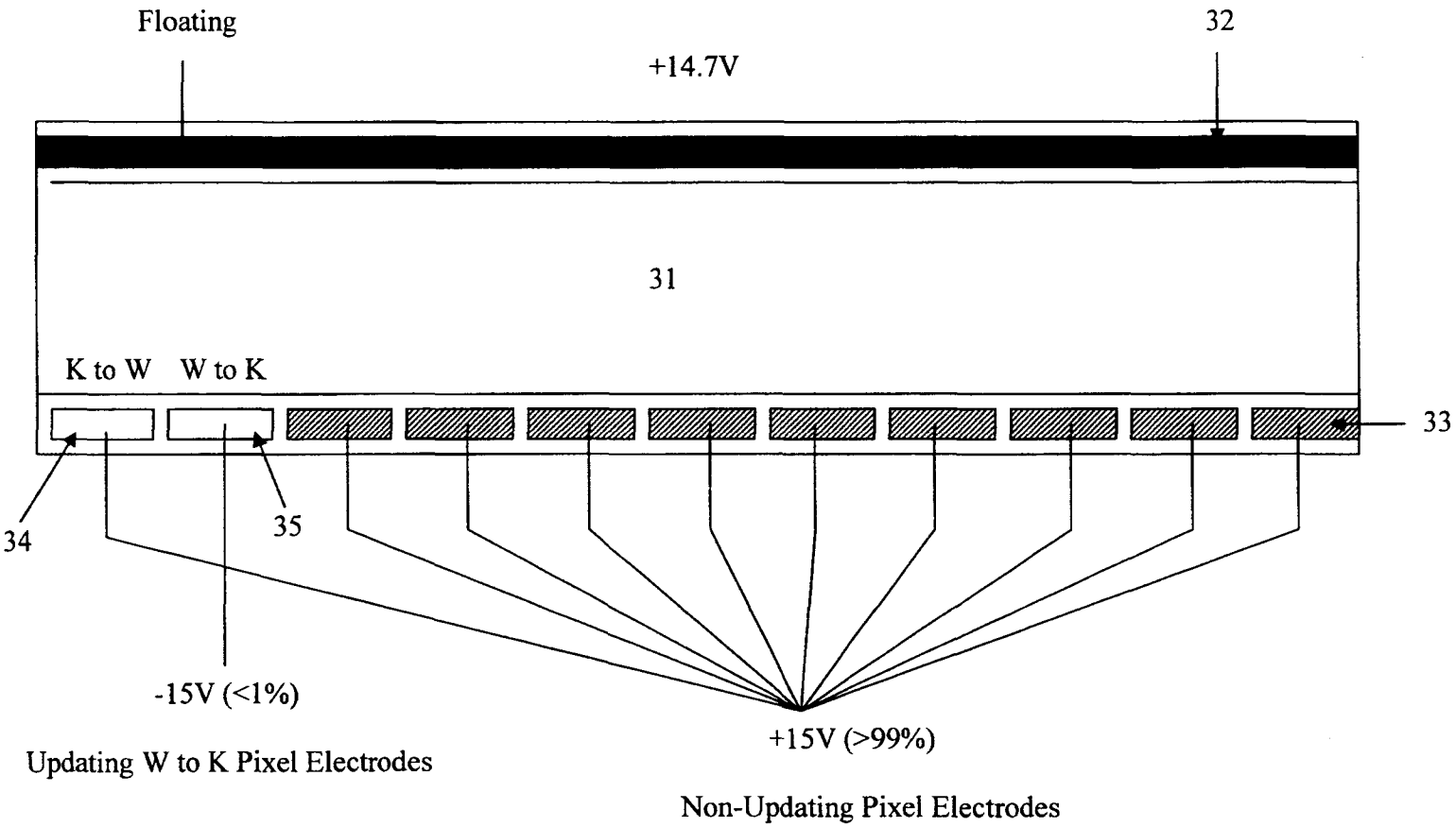

FIGS. 5*b* and 5*c* show two phases of this uni-polar driving method. In the updated areas, there are areas which will switch from a white (W) state to a black (K) state and remaining areas which will switch from the black state (K) to the white state (W). The updating pixel electrodes in FIGS. 5*b* and 5*c* are marked in the color state before the updating is implemented.

In the first phase of this uni-polar driving, a voltage of −15V is first applied to all non-updating pixel electrodes and the "W to K" updating pixel electrodes 35 and a voltage of +15V, at the same time, is applied to the "K to W" updating pixel electrodes 34. The floating common electrode will have a voltage:

$$V_{common}=(-15V)\times 0.99+(+15V)\times 0.01=-14.7V.$$

Under such a voltage of the common electrode, the driving voltage for the non-updated areas and the "W to K" updated areas is only −0.3V which is insignificant in moving the charged pigment particles. However for the "K to W" updated areas, the driving voltage would be +29.7V which will move the positively charged white particles towards the common electrode, thus causing the white color to become visible.

After the "K to W" updated areas have achieved the desired white color state, those pixel electrodes are then included in the non-updating pixels in the second phase of uni-polar driving as shown in FIG. 5*c*. In this phase, a voltage of +15V is applied to all non-updating pixel electrodes, including pixel electrodes 34, and a voltage of −15V, at the same time, is applied to all "W to K" updating electrodes 35. The floating common electrode in this phase will have a voltage:

$$V_{common}=(+15V)\times 0.99+(-15V)\times 0.01=+14.7V.$$

Under such a voltage of the common electrode in the second phase, the driving voltage for the non-updated areas is +0.3V which is insignificant in moving the charged pigment particles. For the updated areas, the driving voltage would be −29.7V which will move the positively charged white particles towards the pixel electrodes, thus causing the black color to be seen.

It should be noted that in calculating the voltage for the floating common electrode, the numbers 99% and 1% are used even though the non-updated areas should be higher than 99% because of the inclusion of the "W to K" updated areas in the first phase and the "K to W" updated areas in the second phase; but the differences are negligible.

Figure 5D:
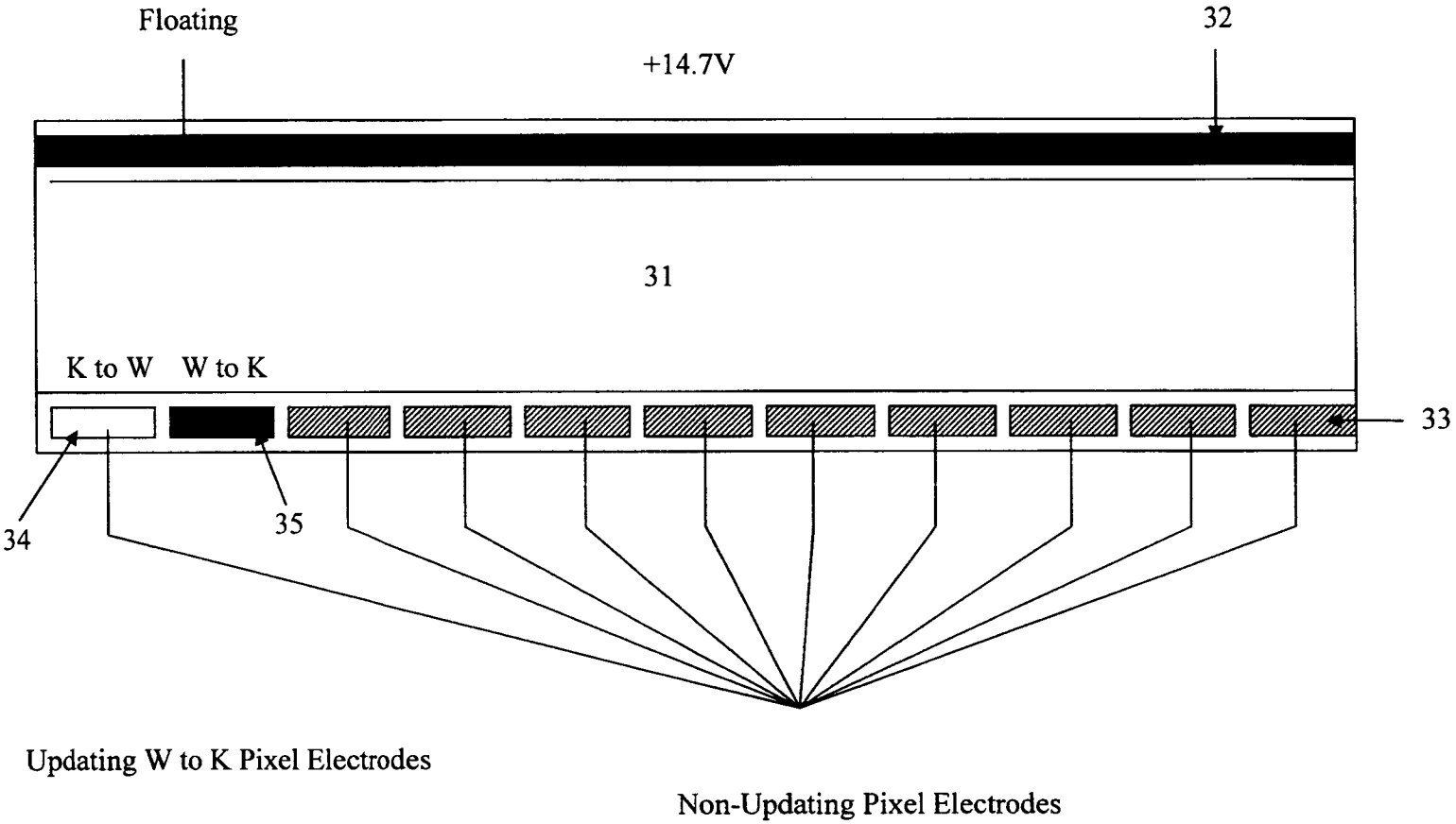

FIG. 5*d* illustrates the results after the voltages are applied in the second phase. In this case, the areas influenced by pixel electrodes 34 was updated in the first phase from K (black) to W (white), and the areas influenced by pixel electrodes 35 was updated in the second phase from W (white) to K (black).

The two phase driving is only needed in a uni-polar approach when there are updated areas which would change from a first color to a second color and the remaining updated areas which would change from the second color to the first color. If the updated areas would only change to a single color state (e.g., black or white), only one phase driving would be sufficient.

Example 2

Bi-polar Approach of the Driving Method

Figure 6A:
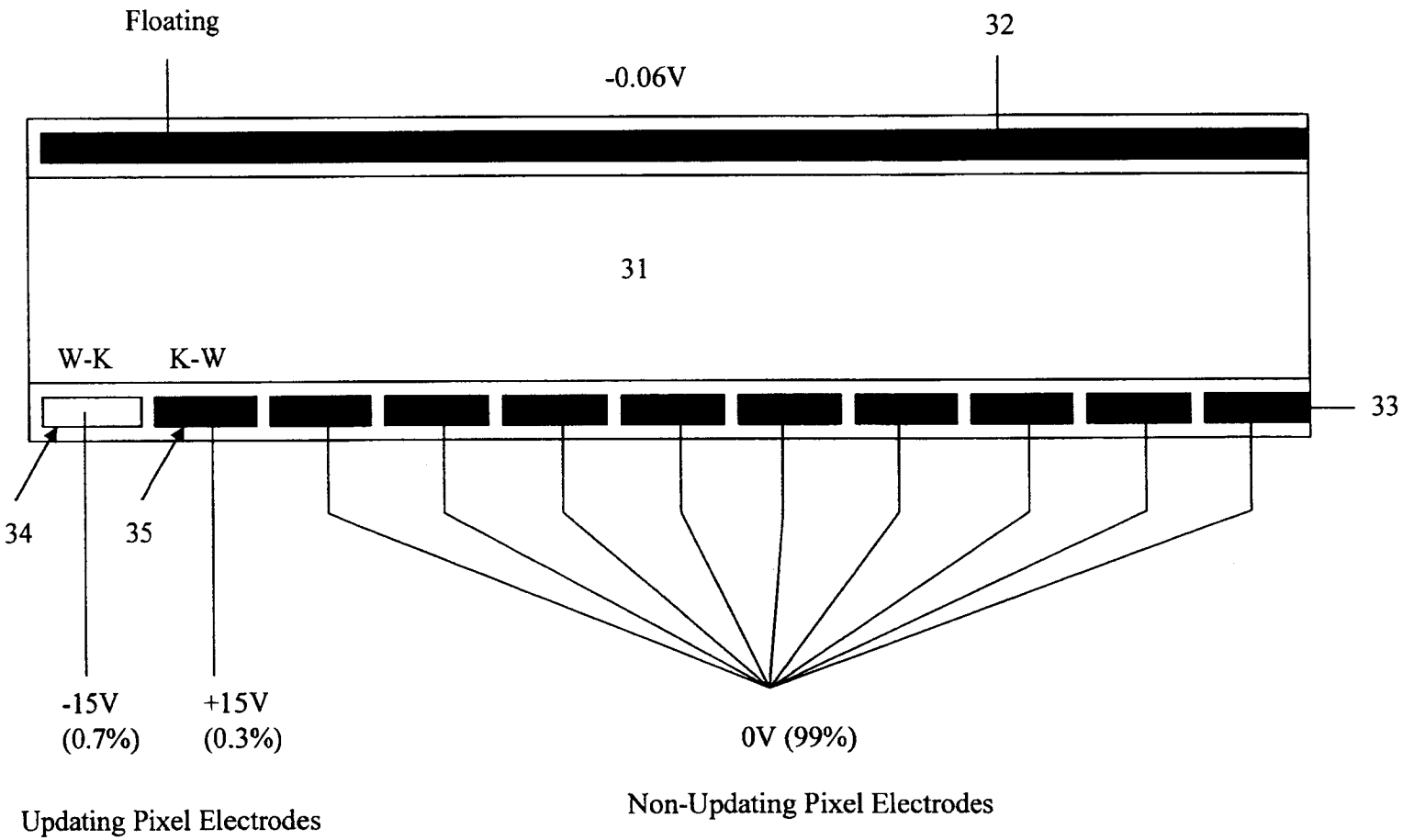
FIGS. 6*a*-6*b* illustrate a bi-polar driving method of the present invention.
Figure 6B:
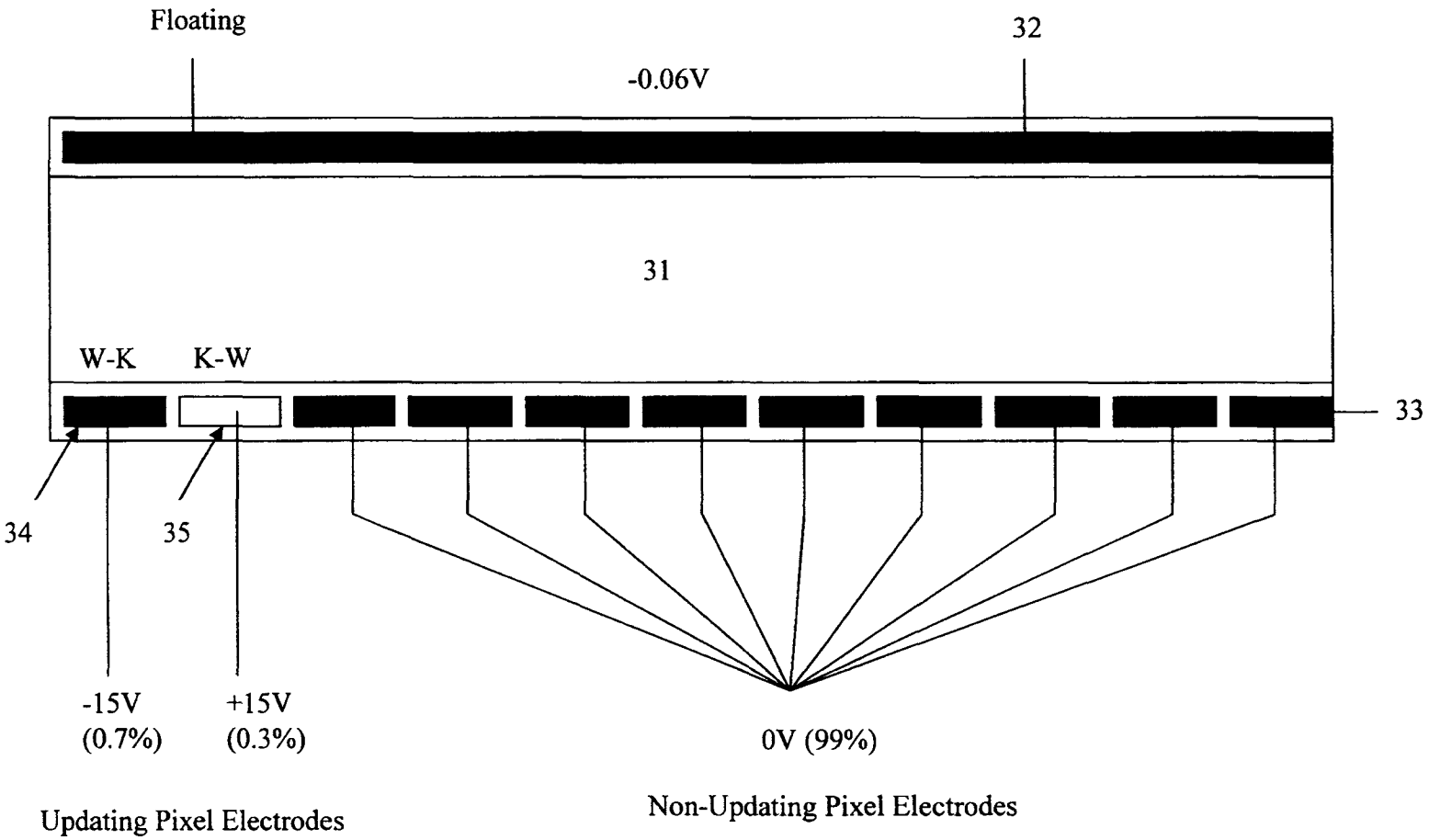

FIGS. 6*a*-6*b* illustrate a bi-polar driving method of the present invention utilizing the concept of "floating common electrode". FIG. 6*a* illustrates the color of the pixels before the updating as indicated by the color of the pixel electrodes 34 and 35. FIG. 6*b* illustrates the color of the pixels after the updating as indicated by the color of the pixel electrodes 34 and 35.

In this example, 99% of the image remains unchanged while 0.3% of the updated areas changes from black to white and 0.7% of the updated areas changes from white to black. In carrying out the bi-polar driving method of the present invention, the non-updating pixel electrodes 33 are applied no voltage while at the same time a voltage of +15V is applied to the "K to W" updating pixel electrodes 35 and −15V is applied to the "W to K" updating pixel electrodes 34. The floating common electrode will have a voltage:

$$V_{common}=0V\times 0.99+(+15V)\times 0.003+(-15)\times 0.007=-0.06V$$

Under such a voltage of the common electrode, the driving voltage for the non-updated areas is +0.06V which is insignificant in moving the charged pigment particles. For the "K to W" updated areas, the driving voltage would be +15.06V which will move the positively charged white particles towards the common electrode, thus causing the white color to be seen. For the "W to K" updated areas, the driving voltage would be −14.94V which will move the positively charged white particles towards the pixel electrodes 34, thus causing the black color to be seen.

When the present driving methods of this invention are applied either via the uni-polar approach or the bi-polar approach, preferably the updated areas between two consecutive images are about 15%, preferably about 10%, or less of the total image area. In other words, about 85%, preferably about 90%, or more of the original image is un-changed in the next image. However, there are applications for electrophoretic displays where in one time period a substantial update of the pixels is required, and in another time period a partial update of the pixels is required. One can define "substantial update" as the case where more than about 15%, preferably about 10%, of the images are updated, and "partial update" as the case where less than about 15%, preferably about 10%, of the images are updated.

Figure 7:
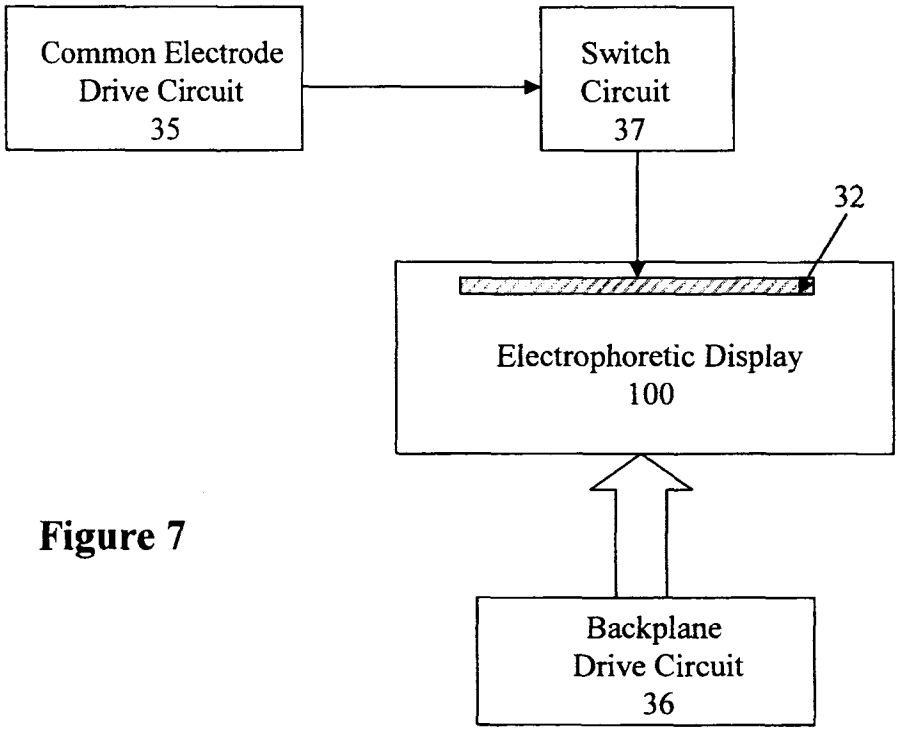
FIG. 7 illustrates a system comprising a switch circuit.

In FIG. 7, a system is illustrated that allows an electrophoretic display to operate with the partial update driving method of the present invention along with the traditional driving as illustrated in FIG. 3 when a substantial update is required. As illustrated in FIG. 7, when a substantial update is required, the switch circuit 37 is a closed circuit so that the common electrode drive circuit 35 is coupled to the common electrode 32 of the electrophoretic display 100. This connection allows the common electrode drive circuit 35 to apply a voltage to the common electrode 32.

However, when a partial update is required, switch circuit 37 is an open circuit so that the common electrode drive circuit 35 is not coupled to the common electrode 32; hence the common electrode is in a floating mode. In this situation, the floating common electrode 32 will have a voltage based upon the voltages of the backplane drive circuit as applied to the non-updating and updating pixel electrodes, and the percentage of updated areas and the percentage of non-updated areas. The designer of an electrophoretic display system can program the operation of the switch circuit 37 based upon the specific application requirements. When a display is in use, a display controller, based on the images to be displayed, opens or closes the switch circuit.

In the discussion above, the voltage of +15V or −15V is used for illustration purpose. It is noted that other voltages would also be suitable. The voltages used may generally be expressed as the first voltage, the second voltage, the third voltage, etc.

While the colors of black and white is used for illustration purpose. The present methods can be used in any binary color systems as long as the two colors provide sufficient contrast to be visually discernable. Therefore the two contrasting colors may be broadly referred to as "a first color" and "a second color".

Although the foregoing disclosure has been described in some detail for purposes of clarity of understanding, it will be apparent to a person having ordinary skill in that art that certain changes and modifications may be practiced within the scope of the appended claims. It should be noted that there are many alternative ways of implementing both the process and apparatus of the improved driving scheme for an electrophoretic display, and for many other types of displays including, but not limited to, liquid crystal, rotating ball, dielectrophoretic and electrowetting types of displays. Accordingly, the present embodiments are to be considered as exemplary and not restrictive, and the inventive features are not to be limited to the details given herein, but may be modified within the scope and equivalents of the appended claims.

What is claimed is:

1. A method for driving from a first image to a second image in an electrophoretic display wherein there are non-updated areas and updated areas between the first and second images, which method comprises the steps of:

a) applying a first voltage ($V_1$) to pixel electrodes associated with non-updated areas which are % $A_{NU}$ of the total image area; and b) applying a second voltage ($V_2$) to pixel electrodes associated with updated areas which are % $A_U$ of the total image area;

whereby a floating common electrode not connected to a driving circuit has a third voltage ($V_3$) which is $V_1 \times \% A_{NU} + V_2 \times \% A_U$; and a driving voltage created between the first voltage ($V_1$) and the third voltage ($V_3$) causes no image update in the non-updated areas and a driving voltage created between the second voltage ($V_2$) and the third voltage ($V_3$) is sufficient to cause the updated areas updated.

2. The method of claim 1, wherein the first voltage ($V_1$) is plus V (+V) and the second voltage ($V_2$) is minus V (−V) or vice versa.

3. The method of claim 1 wherein the % $A_{NU}$ is more than 90% between the first and second images.

4. The method of claim 3, which is carried out in conjunction with a driving method for substantial image update in which the % $A_{NU}$ is 90% or less, via a switch circuit.

5. A bipolar method for driving from a first image to a second image in an electrophoretic display wherein there are non-updated areas, updated areas which will switch from a first color to a second color and updated areas which will switch from the second color to the first color between the first and second images, which method comprises the steps of:

a) applying a first voltage ($V_1$) to pixel electrodes associated with non-updated areas which are % $A_{NU}$ of the total image area;

b) applying a second voltage ($V_2$) to pixel electrodes associated with updated areas which will switch from the first color to the second color, which updated areas are % $A_{U1\rightarrow 2}$ of the total image area; and c) applying a third voltage ($V_3$) to pixel electrodes associated with updated areas which will switch from the second color to the first color, which updated areas are % $A_{U2\rightarrow 1}$ of the total image area;

whereby a floating common electrode not connected to a driving circuit has a fourth voltage ($V_4$) which is $V_1 \times \% A_{NU} + V_2 \times \% A_{U1\rightarrow 2} + V_3 \times \% A_{U2\rightarrow 1}$; and a driving voltage created between the first voltage ($V_1$) and the fourth voltage ($V_4$) causes no image update in the non-updated areas, a driving voltage created between the second voltage ($V_2$) and the fourth voltage ($V_4$) is sufficient to switch the updated areas from the first color to the second color and a driving voltage created between the third voltage ($V_3$) and the fourth voltage ($V_4$) is sufficient to switch the updated areas from the second color to the first color.

6. The method of claim 5, wherein the % $A_{NU}$ is more than 90% between the first and second images.

7. The method of claim 5, wherein the first voltage ($V_1$) is 0V, the second voltage ($V_2$) is plus V (+V) and the third voltage ($V_3$) is minus V (−V) or the first voltage ($V_1$) is 0V, the second voltage ($V_2$) is minus V (−V) and the third voltage ($V_3$) is plus V (+V).

8. The method of claim 6, which is carried out in conjunction with a driving method for substantial image update in which the % $A_{NU}$ is 90% or less, via a switch circuit.

9. The method of claim 5, wherein the first color is black and the second color is white or vice versa.

10. A uni-polar method for driving from a first image to a second image in an electrophoretic display wherein there are non-updated areas which are % $A_{NU}$ of the total image area and updated areas which are % $A_U$ of the total image area between the first and second images, which method comprises the steps of:

a) applying a first voltage ($V_1$) to a first group of pixel electrodes associated with the non-updated areas and a second group of pixel electrodes associated with the updated areas which will switch from a first color to a second color; and b) applying a second voltage ($V_2$) to a third group of pixel electrodes associated with the updated areas which will switch from the second color to the first color;

whereby a floating common electrode not connected to driving circuit has a third voltage ($V_3$) which is $V_1 \times \% A_{NU} + V_2 \times \% A_U$; and a driving voltage created between the first voltage ($V_1$) and the third voltage ($V_3$) causes no switch of color in areas associated with the first and second groups of pixel electrodes and a driving voltage created between the second voltage and the third voltage causes the updated areas associated with the third group of pixel electrodes to switch from the second color to the first color.

11. the method of claim 10, further comprising the steps of:

a) applying a fourth voltage ($V_4$) to the first group of pixel electrodes associated with the non-updated areas and the third group of pixel electrodes associated with the updated areas which already switched from the second color to the first color; and b) applying a fifth voltage ($V_5$) to the second group of pixel electrodes associated with the updated areas which will switch from the first color to the second color;

whereby a floating common electrode not connected to a driving circuit has a sixth voltage ($V_6$) which is $V_4 \times \% A_{NU} + V_5 \times \% A_U$; and a driving voltage created between the fourth voltage ($V_4$) and the sixth voltage ($V_6$) causes no switch of color in areas associated with the first and third groups of pixel electrodes and a driving voltage created between the fifth voltage ($V_5$) and the sixth voltage ($V_6$) is sufficient to switch the updated areas associated with the second group of pixel electrodes from the first color to the second color.

12. The method of claim 11, wherein the $\% A_{NU}$ is more than 90% between the first and second images.

13. The method of claim 10, wherein the first voltage ($V_1$) is plus V (+V) and the second voltage ($V_2$) is minus V (−V) or vice versa.

14. The method of claim 11, wherein the fourth voltage ($V_4$) is plus V (+V) and the fifth voltage ($V_5$) is minus V (−V) or vice versa.

15. The method of claim 12, which is carried out in conjunction with a driving method for substantial image update in which the $\% A_{NU}$ is 90% or less, via a switch circuit.

16. The method of claim 11, wherein the first color is black and the second color is white or vice versa.

17. A system for driving an electrophoretic display, which system comprises:

a common electrode drive circuit coupled to a switch circuit;

the switch circuit coupled to a common electrode of an electrophoretic display;

a backplane drive circuit coupled to pixel electrodes of the electrophoretic display; and wherein when the switch circuit is an open circuit, the voltage of the common electrode is $\Sigma\{V_U \times \% A_U\} + V_{NU} \times \% A_{NU}$ in which $V_U$ is the voltage applied to updating pixel electrodes, $V_{NU}$ is the voltage applied to non-updating pixel electrodes, $\% A_U$ is the percentage of updated areas of the total image area and $\% A_{NU}$ is the percentage of non-updated areas of the total image area.

18. The system of claim 17, wherein the switch circuit is a closed circuit when more than about 10% of the total image area is updated and the switch circuit is an open circuit when less than about 10% of the total image area is updated.

* * * * *